United States Patent [19]

Fronheiser et al.

[11] Patent Number: 4,872,270

[45] Date of Patent: Oct. 10, 1989

[54] DRYING PROCESS

[75] Inventors: Dennis R. Fronheiser, Rochester; Jack Hayward, Hilton; Gerald G. Reafler, Rochester; James R. Schuler, Brockport, all of N.Y.

[73] Assignee: Eastman Kodak Company, Rochester, N.Y.

[21] Appl. No.: 166,083

[22] Filed: Mar. 9, 1988

[51] Int. Cl.[4] ..... F26B 3/02; F26B 13/00

[52] U.S. Cl. ..... 34/23; 34/26; 427/372.2

[58] Field of Search ..... 34/155, 156, 152, 148, 34/26, 32, 41, 50, 46; 427/331, 372.2

[56] References Cited

U.S. PATENT DOCUMENTS

| | | | |
|---|---|---|---|
| 2,681,294 | 6/1954 | Beguin | 117/34 |
| 3,151,950 | 10/1964 | Newman et al. | 34/155 X |
| 3,231,985 | 2/1966 | Smith | 34/155 X |
| 4,051,278 | 9/1977 | Democh | 427/326 |
| 4,365,423 | 12/1982 | Arter et al. | 34/23 |
| 4,719,132 | 1/1988 | Porter | 427/409 |

FOREIGN PATENT DOCUMENTS

| | | |
|---|---|---|
| 6719687 | 1/1986 | Australia . |
| 0230364 | 7/1987 | European Pat. Off. . |
| 0251546 | 3/1988 | European Pat. Off. . |
| 0261815 | 3/1988 | European Pat. Off. . |
| 2091859 | 8/1982 | United Kingdom . |

*Primary Examiner*—Henry A. Bennet

*Attorney, Agent, or Firm*—William J. Davis

[57] ABSTRACT

A latex paint containing water and one or more higher boiling organic solvents is coated on a carrier film and dried by a process which yields a dried paint layer free of bubble defects. The film is passed continuously through a series of at least three drying stages in contact with warm, moderately humid air and more than half of the heat required for evaporation is supplied to the underside of the film. Drying conditions in at least each of the first three stages are controlled to maintain a film temperature profile which causes the water to evaporate at a moderate rate but more rapidly than the organic solvents, thus achieving coalescence of the paint and avoiding the trapping of liquids in a surface-hardened paint layer.

15 Claims, 4 Drawing Sheets

DRYING PROCESS

FIELD OF THE INVENTION

This invention relates to an industrial drying process and more particularly to a process for drying a paint layer which is coated on a plastic carrier film.

BACKGROUND OF THE INVENTION

As an improvement over the spray painting of articles such as automobile bodies and household appliances, a new kind of sheet material has been developed to provide protective and decorative coatings. The new material comprises a thin, flexible, stretchable, thermoplastic support sheet, known as a carrier film, which has a protective and decorative paint layer on one side and an adhesive on the other side. Optionally, it can also have other layers such as a tie or bonding layer between the paint and the carrier film and a clearcoat over the paint or basecoat layer. Using the known procedure of thermoforming, the sheet material can be stretched and bonded to an article such as an automobile body panel. Important advantages over spray painting include economy in the use of paint and avoidance of air pollution by evaporating solvents. Furthermore, the new material has a remarkably more attractive appearance than spray painted finishes.

The new type of sheet material and a process for its manufacture are described in the U.S. Patent Application of G. G. Reafler, Serial No. 116,426, filed Nov. 3, 1987. The process involves providing a laminar flow of the coating composition on the surface of the thermoplastic carrier film to form a layer of substantially uniform thickness, followed by a drying procedure, then coating and drying each additional layer in sequence to obtain a finished product of excellent gloss and smoothness.

The present invention provides a further improvement in the form of a new drying procedure for the paint layer of such sheet material. Although the layers of the sheet material of the Reafler patent application can be dried by conventional procedures, it has been found that because of its complex composition and its thickness, the paint layer is particularly sensitive to the drying conditions.

The paint layer is formed from a latex paint composition comprising a colloidal suspension in water of water-insoluble elastomeric polymers and also contains one or more higher boiling organic solvents which function as coalescing agents or have other purposes. A composition of this kind, when dried on the stretchable thermoplastic support film, has the flexibility, stretchability and durability that are necessary for sheet material that is to be stretched and adhered to automobile panels and the like. Such a paint composition dries reasonably well when applied by spray painting in thin layers directly to automotive body panels, since much of the liquid evaporates when sprayed. In this respect spray painting differs markedly from laminar flow coating in which little or no liquid evaporates as the composition is coated on the carrier film support. In any event, the drying defects that occur when a spray painted layer is dried in a conventional drying oven apparently do not noticeably worsen the otherwise lower quality of spray painted finishes.

With the new sheet material for applying finishes to automobile body panels, a new level of quality is the rule. Defects such as small blisters and "solvent pops" are no longer considered acceptable. This has led to the need for an improvement in the procedure for drying the paint layer so that wide sheet material can be produced with minimal loss of product as waste caused by bubble defects which originate in the paint layer. In accordance with the present invention a new method is provided which is particularly adapted for drying a thick paint layer coated on a heat-deformable plastic film when the wet paint layer contains a coalescable and hardenable, film-forming polymer colloidally dispersed in water with one or more higher boiling organic solvents.

BRIEF SUMMARY OF THE INVENTION

The new process for drying coated plastic film comprises continuously passing through a series of at least three drying stages a heat-deformable plastic film which on its upper surface has a coating of wet latex paint. This paint contains water, one or more higher boiling organic solvents and a colloidally dispersed, coalescable and hardenable, elastomeric film-forming polymer.

A flow of heated, moderately humid air is introduced to each stage to supply heat and cause evaporation of water and organic solvent, the air flow in at least the first three stages being so directed that more than half of the heat required for evaporation in these stages is supplied to the film through its under surface.

In a first stage of at least 30 seconds duration, the evaporation conditions, including the flow rate, humidity and temperature of the air are controlled to maintain the temperature of the paint layer within about 10 degrees C below and 5 degrees C above its initial temperature.

In a second stage of at least 30 seconds duration conditions are maintained which heat the paint layer to a temperature higher than in said first stage but no higher than 10 degrees C above its initial temperature.

In a third stage of at least 30 seconds duration conditions are maintained which heat the paint layer to a temperature higher than in said second stage but no higher than 25 degrees C above its initial temperature.

Thereafter in a final stage, conditions are maintained which heat the paint layer to a maximum temperature at least 30 degrees C higher than the highest temperature in the third stage and at least 50 degrees C higher than its initial temperature for sufficient time to evaporate remaining water and organic solvent and harden the paint layer, the temperature being below the heat deformation temperature of the carrier film. The result of the process is a smooth, stretchable, dried paint, layer which is substantially free of bubble defects.

THE DRAWINGS

FIG. 1 of the drawings is a highly enlarged, diagrammatic cross-sectional view of a partially completed form of the sheet material which is dried by the method of invention.

DETAILED DESCRIPTION OF THE INVENTION

Figures 1, 2, 4:
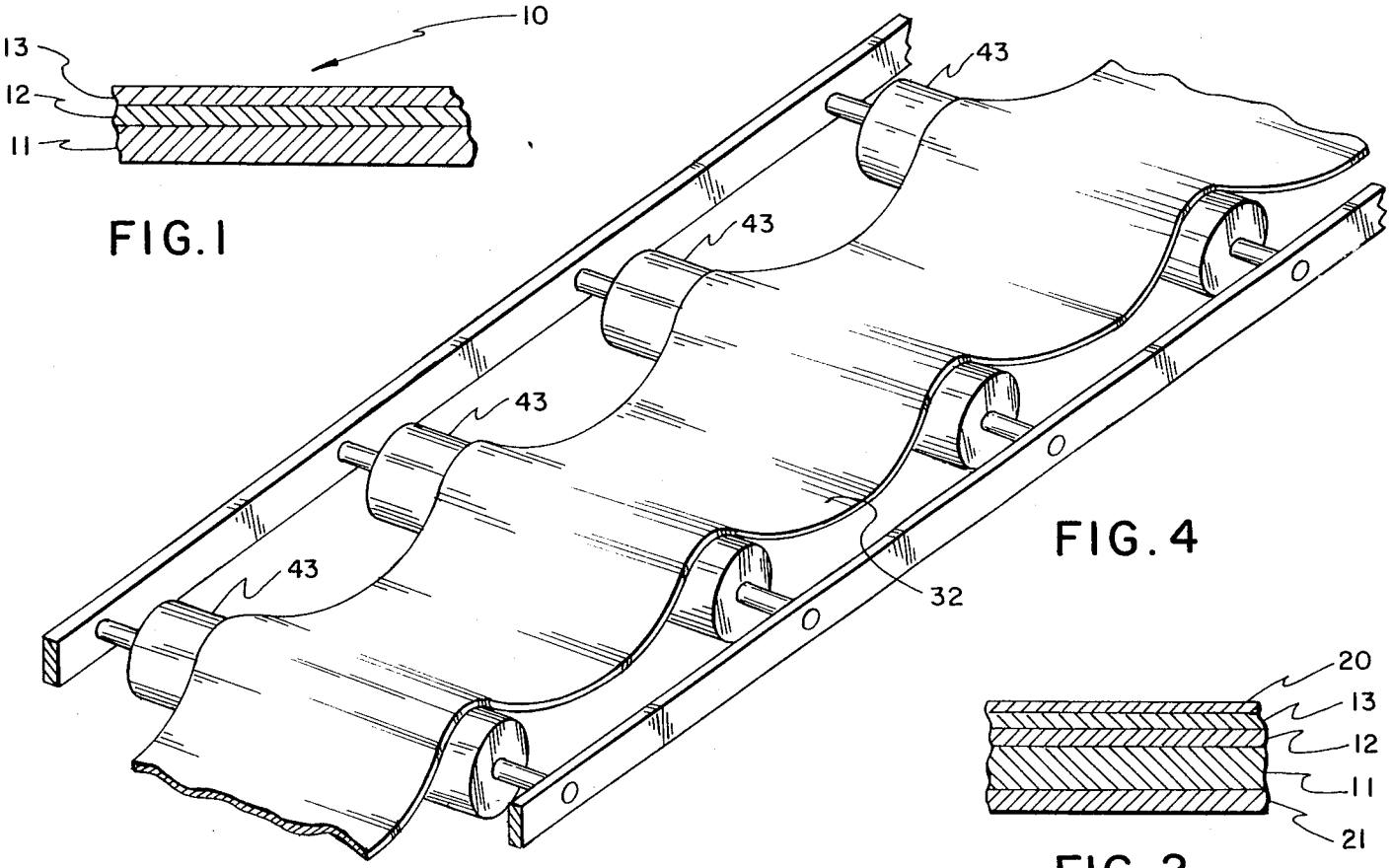
FIG. 2 is a similar view of another form of the sheet material with additional layers shown.
FIG. 4 is a diagrammatic perspective view of a portion of the apparatus of FIG. 3, showing film passage through the apparatus.

Referring first to FIG. 1, the figure shows in cross section the sheet material in an intermediate stage at which the drying process of the invention can be applied. The sheet material 10 consists of thermoplastic carrier film 11 having a thickness e.g., of about 0.05 to 0.40 mm and, preferably, of about 0.16 to 0.32 mm, on which is coated a thin tie-coat or bonding layer 12, (thickness less than about 0.0025 mm) which is optional in some embodiments. Normally, however, it is used to improve the bonding between carrier film 11, which normally is hydrophobic, and the aqueous latex paint layer 13.

The optional tie-coat layer 12 of FIG. 1 is applied to the carrier film 11 by a laminar flow coating method as described in the Reafler application and the film is then passed through a drying chamber. The tie coat composition, a specific example of which will be described later, comprises an adhesion-promoting polymer and a volatile organic solvent. Its composition, as compared with that of the paint layer, is relatively simple and the coating is thin. Therefore, it can be dried by conventional procedure in a flat-bed, continuous dryer through which warm dry air is flowed, e.g. at 25–100 C, the temperature, however, being kept below the thermal deformation temperature of the carrier film to avoid deforming the film.

The paint layer 13 of FIG. 1 is the layer to which the drying process of the present invention particularly applies. This layer too is coated by laminar flow as described in the Reafler patent application. It is coated over the optional tie-coat 12 or directly on the carrier film 11 if the compositions of the film and the paint are sufficiently compatible for good adhesion without a tie coat. The thickness of the paint layer is greater than is normal, for high precision layers such as photographic compositions which have in the past been coated on plastic films by laminar flow methods. Its dry thickness can be from about 0.012 to 0.080 mm and, most suitably, is from about 0.02 to 0.060 mm. Such a thickness is needed in order that the pigmented paint layer will provide good hiding power when the film is stretched (and, therefore, thinned out) and adhered to automobile panels or other three dimensional articles.

In any event, the paint composition includes a colorant, one or more film-forming binder polymers, water, organic solvents and, in certain embodiments, suspended particles such as metal flakes. Because of the complexity of its composition and because of the thickness of the layer it presents unusual problems in drying.

After drying the paint layer of the FIG. 1 product, additional layers are coated and dried to provide the more complete sheet material illustrated in FIG. 2. The latter is of the so-called basecoat/clearcoat or color-plus-clear type and has a top-coat 20 (also called a clear coat) over the paint layer (also called a basecoat) and an adhesive layer 21 on the under surface of film 11, all as described in the Reafler application. Not shown in FIG. 2 is an optional plastic release sheet which can be releasably adhered to adhesive layer 21 and stripped off when the sheet material is to be bonded to an automotive body panel or the like.

Figure 3:
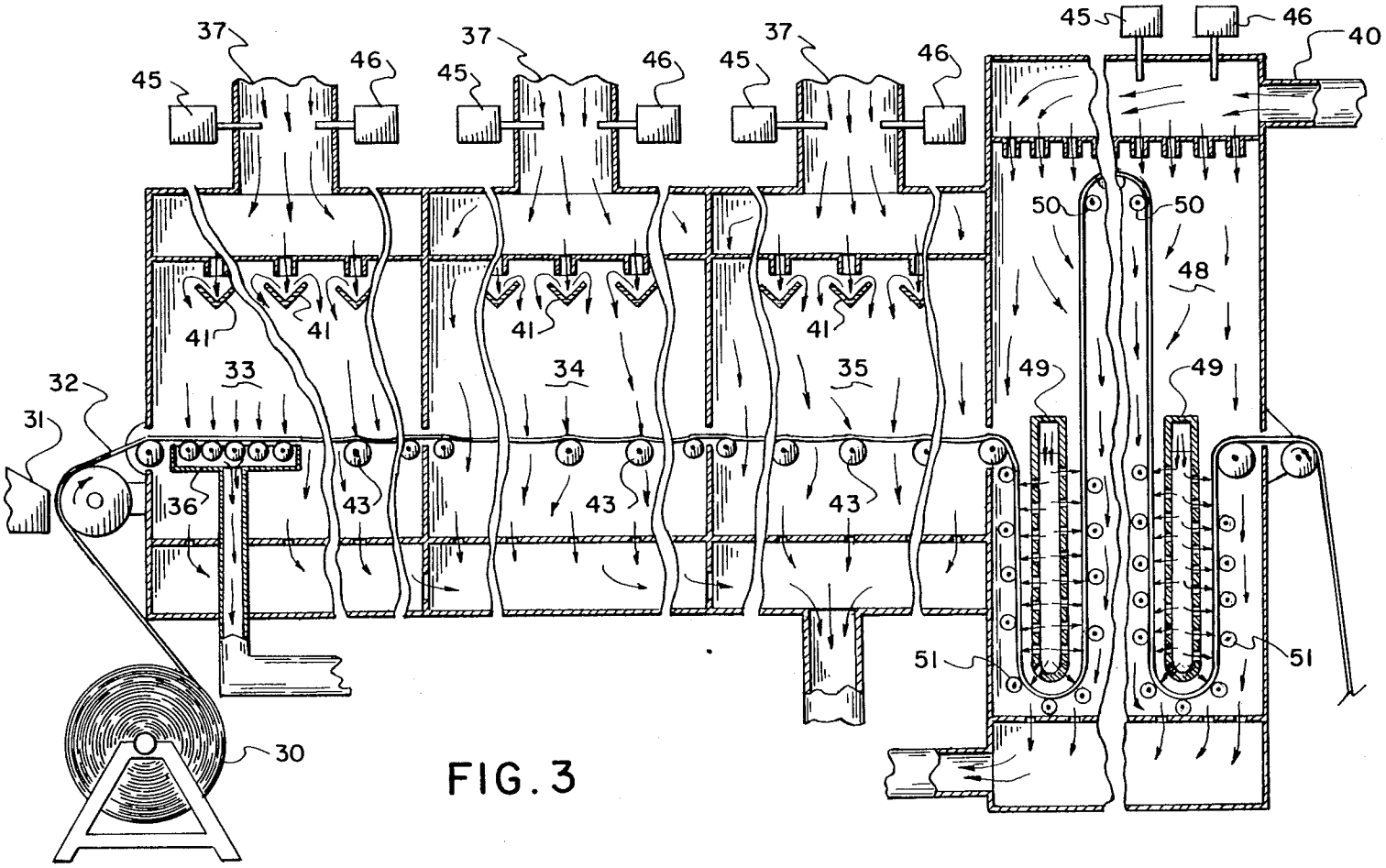
FIG. 3 is a diagrammatic side view in section with parts broken away showing the passage of coated film through sequential drying stages in one form of apparatus in which the process of the invention can be carried out.

FIG. 3 diagrammatically illustrates one suitable type of drying apparatus for use in the process of the present invention. As explained in the Reafler patent application, the manufacture of the stretchable sheet material starts with the thin flexible support or carrier film, which is a stretchable, heat-deformable plastic film such as disclosed in the patent to Weemes et al, U.S. 4,582,876 issued April 15, 1986. After coating and drying the tie coat, the film is rewound as supply roll 30 for the coating of the paint layer. For applying the latter, the film is fed continuously as a web from roll 30 to a laminar flow coating apparatus such as an extrusion coating hopper which is indicated diagrammatically as hopper 31. Several types of precision coating apparatus for laminar flow coating of thin layers with high uniformity can be used, including extrusion hoppers, slide hoppers and curtain coating apparatus as mentioned in the Reafler patent application. Preferably the coating apparatus is of the kind used in the precision coating of photographic products as described, for example, in U.S. Pat. Nos. 2,253,060; 2,289,798; 2,681,294; 2,815,307; 2,898,882; 2,901,770; 3,632,374 and 4,051,278.

The drying process of the present invention offers its most important advantages with water-based paint compositions which are designed as automotive finishes and which have heat softening and tensile elongation properties that are compatible with those of the stretchable carrier film. Such paint compositions when dried must be flexible and stretchable and must have durability and resistance to weathering. They must also have good adhesive and cohesive strength. Paint compositions having this unusual combination of properties are complex. Examples of such compositions are listed in Tables I, II and III.

TABLE I

| Ingredient | Approximate % Weight |
|---|---|
| Deionized water | 50 |
| Urethane resin | 25 |
| Aluminum paste | 5 |
| Ethylene Glycol Monohexyl Ether | 5 |
| N—Methylpyrrolidone | 5 |
| Diethylene Glycol Monobutyl Ether | 1 |
| N,N—Dimethyl Ethanolamine | 1 |
| Xylene | 1 |
| Aliphatic Solvent Naphtha | 1 |
| Isopropyl Alcohol | <1 |

TABLE II

| Ingredient | Approximate % Weight |
|---|---|
| Deionized water | 55 |
| Urethane resin | 20 |
| Ethylene Glycol Monohexyl Ether | 5 |
| N—Methylpyrrolidone | 5 |
| Diethylene Glycol Monobutyl Ether | 1 |
| N,N—Dimethyl Ethanolamine | 1 |
| Titanium Dioxide/Mica | <1 |
| Silica | <1 |
| Carbon Black | <1 |
| Isopropyl Alcohol | <1 |

TABLE III

| | |
|---|---|
| Titanium Dioxide | 25 |
| Ethylene Glycol Monohexyl Ether | 5 |
| Diethylene Glycol Monobutyl Ether | 1 |
| Deionized Water | 45 |
| N,N—Dimethyl Ethanolamine | 1 |

TABLE III-continued

| | |
|---|---|
| N—Methylpyrrolidone | 5 |
| Urethane Resin | 20 |

The above listed paint compositions have heat softening and tensile elongation properties that are compatible with carrier films made of the polymeric compositions described in the patent to Weemes et al, U.S. 4,582,876.

These are latex paint compositions which contain a large amount of water, e.g., 40 weight percent or more, plus substantial amounts of higher boiling organic solvents, the latter serving, among other things, as coalescing agents. They also have high solids content, eg., 20 to 45 weight percent. When such compositions are coated on wide carrier films and dried by known procedures, it has been found that the coatings have a number of bubble-related defects. The result is an undesirable amount of waste. These defects can be eliminated or reduced to an acceptable level by using the drying process of the invention.

The paint formulations of Tables I, II & III show that the process of the invention must be capable of drying coating compositions that have a high solids content, e.g., of the order of 20 weight percent solids or higher. Such a high solids content and the thickness of the paint coating complicate the initial drying stage, the reason being that the evaporation of the water is to some degree impeded because of the tortuous and long path that the water must take through the mass of solids. The difficulty is even greater when, like the composition of Table I, the paint also contains reflective flakes of aluminum or other metals which can range in concentration, e.g., from about 1 to 10 weight percent of the wet paint. However, in accordance with the present invention, when the film temperature is controlled in each stage by control of the drying conditions and by supplying heat to the underside of the film, even such thick, high solids-content paint coatings are dried without producing excessive bubble defects in the dried film.

Referring again to FIG. 3, the coated film 32 after application of a paint or basecoat composition to its upper surface at the coating station 31, passes horizontally into the drying chamber at an initial temperature which normally is room temperature, e.g., around 20 degrees C. The initial film temperature, however, can be above or below room temperature if, for example, it is desired to alter the physcial properties of the paint by warming or cooling it before it is coated on the film.

The drying chamber provides a series of drying stages 33, 34, 35 and 36 of sequentially higher temperatures. Air enters the first stage 33 of the drying chamber via conduit 37 at a moderate rate. In this first stage the wet surface is protected against direct air impingement, e.g., by means of baffles, which results in laminar air flow. The air temperature in the first stage is also relatively low, e.g., no more than about 35 degrees C., and its humidity is sufficiently high that the drying rate in the first stage is low. Thus, the air is warm, not hot, and it is moderately humid. Mainly water evaporates in this first stage. The film or coating temperature is so low that no substantial amounts of the higher boiling organic solvents evaporate, e.g., no more than about 10 weight percent, and usually much less, of the organic solvents that are higher boiling than water evaporate in the first stage.

As distinguished from prior art processes for drying other kinds of film coatings with dry, hot air, the air, at least in the first two stages of the present process, is moderately humid. If it is too dry in the initial stages the water evaporates too rapidly and surface hardening or "case hardening" of the paint layer occurs. If it is too humid the water evaporates too slowly or not at all, while the organics will gradually evaporate because of their low partial pressure in the drying chamber atmosphere. This can result in depletion of the organics before the water evaporates. The wet paint layer then would no longer contain enough organic solvent to coalesce the polymer particles. Moderate humidity of the inlet drying air for the first stage which avoids these difficulties is in the range from about 5 to 50 percent relative humidity (RH). The second stage inlet air can be less humid, e.g. in the range from about 3 to 20% RH.

In any event, the conditions in the first stage are maintained to evaporate water at a slow rate. Any evaporation of higher boiling organic solvents is at an even slower rate. The drying procedure is thus different from that used in drying aqueous coating materials such as photographic emulsion layers and in drying solvent-based coatings. In both of these types of drying procedures the initial drying rate is faster.

An example of such a faster drying rate is disclosed in the patent to Democh, U.S. 4,051,278 issued Sept. 27, 1977 As FIG. 1 of the patent shows, solvent is evaporated at such a rate that the coated layer cools rapidly below the initial temperature until it reaches a low equilibrium surface temperature. In contrast, in the process of the present invention the drying rate is controlled so that coated layer does not cool much or at all below its initial temperature during the first stage of drying. Heat is supplied to the film at about the same rate that heat is absorbed by evaporation, thus keeping the temperature of the paint layer within about 10 degrees C below and about 5 degrees C above its initial temperature.

The process of the invention also dries the paint layer at a lower temperature and slower rate than is practical in conventional spray painting of automobile bodies. In the latter it is necessary to dry rapidly in order to avoid sag, this being the defect that occurs when a wet paint layer flows gravitationally before it dries or hardens. In the process of this invention, however, after coating the paint on the carrier film, the coated film can be fed in a moderately inclinded plane horizontally to the first drying stage or stages. Since, the paint can coalesce before the film is vertical, sag is not a problem in the process of the invention. Accordingly, the paint need not be dried at such a high temperature and as rapidly as is necessary for avoiding sag with spray painted automotive panels. Instead, it is dried at moderate temperatures and relatively slowly so that premature hardening of the surface is avoided. This permits evaporation of the liquids before they can be trapped in the layer by surface hardening. An advantage of the present process is that the paint layer can be maintained in a horizontal plane until it coalesces and will not sag. However, a moderate inclination in the film plane for all or part of its path is acceptable if the paint composition is sufficiently viscous that an undesirable amount of sagging does not occur.

An important feature of at least the first three drying stages of the new process is that a large amount of the heat supplied to the film to evaporate water and organic solvents is supplied to the underside of the film. More specifically, at least half of the heat of evaporation and, preferably, 60 percent or more is so supplied. A number of structural features of the drying chamber can contribute to supplying heat to the underside of the film. One is to position the air conduits on the underside of the dryer chamber so that the warm air flow impinges against the under surface of the film. This arrangement is not essential, however, or even necessarily preferred.

As shown in FIG. 3, the air conduits 37, 38, 39 and 40 enter the drying stages above the film level. In this arrangement heat can still be supplied to the underside of the film in the drying stages 33, 34 and 35 by providing additional structure to transfer heat to the underside. One possibility is to provide baffles 41 which divert the air flow away from the top of the film and cause it to flow to the lower regions of the chamber. Another possibility is to provide film supporting means such as rollers 36 and 43 which are made of steel, aluminum or other material of good heat conductivity. The rollers are warmed by the air flowing through the chamber and provide an effective heating means. Air flow sufficient to warm the rollers is ensured by providing space between the side walls of the drying chamber and edges of the film. This is shown in an exaggerated scale in FIG. 4. In any event, the air flow over the edges of the film and in contact with the rollers is sufficient to keep them warm so that heat is efficiently supplied to the underside of the film.

In the apparatus of FIG. 3 rollers 36 are closely spaced and thus provide a substantial area for heat exchange with the film. As shown in a somewhat exaggerated scale in FIG. 4, on the more widely spaced rollers 43 the heavy film 32 sags slightly and therefore, also has a substantial area of contact with the rollers. This is sufficient to provide good heat transfer from the warm rollers to the bottom of the film.

Instead of rollers it is also possible to slide the film across heat conductive metal plates, although rollers are preferred for reducing friction. In any event, the desired ratio of heat transfer to the underside versus the upper side can be achieved by adjusting such variables as the position of the air conduits, the positioning of baffles and the selection of an appropriate number of heat-conductive, film supporting means such as rollers or plates.

Although the applicants do not wish to be bound by theoretical explanations, it appears that one reason for the success of the novel process is that the heat supplied to the underside of the film serves to drive water and solvents from the lower levels of the thick paint layer before they can be trapped in the layer by the hardening of the surface. In contrast, if most of the heat is supplied from the top it appears that liquid evaporates mainly from the top of the layer initially and a skin forms at the surface. Then later when the film is heated to hardening temperature the residual liquids trapped under the surface skin vaporize and form blisters or solvents pops.

To establish that the amount of heat supplied through the underside of the film or web exceeds the amount supplied through the upper side, one can use well known principles of heat and mass transfer. A suitable procedure involves the use of mass and energy transfer equations to describe the conditions under which the paint layer is being dried. A mass balance over a region of steady state drying of the paint layer is established to determine the liquid evaporation flux (R. B. Bird et al, *Transport Phenomena,* John Wiley and Sons, Inc., New York, 1960, Chap. 17). This flux is influenced by the temperature of the coated liquid layer, which is itself calculated by an energy balance of the same region of the layer (Bird et al, supra, Chap. 9). The energy balance relates the heat energy transferred into that region thru the upper and under sides of the film to the energy lost from the layer by the evaporation of the liquids (Bird et al, *supra,* Chap. 21). The mass balance and energy balance equations are solved to find a single convergent value of the paint layer temperature which satisfies the relations of the mass and energy equations. The upper and under side heat transfer rates are then modified to correlate with the known paint layer temperature.

While the supply of heat to the underside of the film is one factor in the success of the drying method, it is not the only one. The new process uses this feature in combination with other drying conditions, namely, air flow rate, air temperature in each stage, air humidity and residence time in each stage to maintain a particular film temperature profile throughout the process. It has been found in accordance with the present invention that this combination of film temperature control and underside heat supply enables one to dry the thick latex paint layer and achieve a dry coalesced layer of excellent quality which is substantially free of bubble defects.

In general, the drying conditions in the process of the invention are much less severe than the conditions in the drying or baking ovens for conventional automotive finishes. They are also more moderate in some respects than have normally been used for drying aqueous and solvent-dispersed photographic coating compositions on film substrates. In particular, the air flow rate in the first stage is low. When this low rate of air flow is used in combination with moderate humidity and moderately heated air, the evaporation rate in the first stage is low. It is so low that, in contrast to the drying of solvent-dispersed coating compositions as disclosed in the patent to Democh, U.S. 4,051,278, the film temperature does not decrease substantially. More specifically, the paint layer does not cool more than about 10 degrees C, and preferably not more than 5 degrees C, below the temperature of the film entering the drying chamber, which normally is room temperature (about 20 degrees C). In comparison, as shown by Democh, the temperature of a coated layer can drop rapidly as a result of rapid evaporation in the early part of a drying process.

The control of film temperature provides a measure of the rate of evaporation. When the rate of evaporation is kept so low that the film temperature, i.e., the paint layer temperature, stays within about 10 degrees C below and 5 degrees above its inlet temperature, heat is being supplied to the film at about the same rate at which it is absorbed by evaporation and the evaporation rate is satisfactory.

As has been indicated, the process of the invention addresses the problem of bubble defects in the drying of a latex paint composition coated on a carrier film. The term "bubble defects" refers to defects known in the coating field as blisters and solvent pops. Although, the terms are not precisely used in the art, in general it is understood that blisters ar small bubbles that form in the paint layer when trapped liquid vaporizes and is unable to escape through the prematurely hardened surface. A solvent pop is a defect that usually is seen after the final high temperature curing stage.

The process of the invention yields a dried paint layer which is substantially free of these bubble defects. By this is meant that it has no more than a commercially acceptable number of bubble defects that are visible to the unaided eye. This is usually less than about 20 and preferably less than about 10 bubble defects per square meter. Of course, if defects occur on the edges of the dried film, the film can be trimmed to yield a film of sufficient area for thermoforming which has a suitably low number of defects. When the optimum conditions of the process of the invention are used and the drying operation is slow it is possible to obtain dried film of substantial widths, eg., one meter or more in width, that is totally free of visible bubble defects.

The carrier film on which the paint composition is coated and thereafter dried by the process of the invention is a heat-deformable, stretchable plastic film having physical properties suitable for thermoforming. As already indicated, suitable compositions for such a film include the blends of co-polyesters based on poly (1,4-cyclohexylenedimethylene terephthalate) and rubber-modified styrene-maleic anhydride copolymers having at least two rubbery additives, as disclosed in the patent to Weemes etal, U.S. 4,582,876 and in the copending Reafler application Serial No. 116,426 filed Nov. 3, 1987.

Whatever composition is chosen for the stretchable plastic film, a significant property is that the film is thermoplastic or heat-deformable. This property is necessary in the thermoforming process by means of which the paint-coated films are applied to automotive panels and the like. On the other hand, being thermoformable, the film cannot be heated to the high temperatures that are used in conventional drying ovens for automotive finishes. Each stage of the process of the invention is carried out at a temperature below the heat deformation temperature of the carrier film. The film is also stretchable, which means that when heated to thermoforming temperature it can be stretched to an extended area which is 50 percent or more greater than the original area of the relaxed film without adversely affecting its appearance.

Three specific examples of paint compositions which can be dried by the process of the invention are described above. In general, the process is useful for drying a coating of wet latex paint on a heat-deformable plastic film wherein the paint contains water, one or more higher boiling organic solvents, a pigment or pigments, optional reflective flakes and a collodially dispersed, coalescable, hardenable, stretchable or elastomeric film-forming polymer. A wide range of suitable paint compositions are disclosed in the above-cited Reafler patent application. They are typical of compositions used as automotive finishes under governmental regulations aimed at reducing solvent emissions in the atmosphere. They are water-based, but also contain minor amounts of one or more organic solvents. The latter are needed for coalescense of the polymer film as the water is removed, their function being to soften the polymer particles sufficiently that, when the water evaporates sufficiently, they adhere together and coalesce as a continuous film.

Before the paint composition is coated on the carrier film, a thin, smooth tie coat layer, preferably, is first applied and dried. Since the tie coat is thinner and of a less complex composition it can be dried conventionally. The composition includes one or more adhesion-promoting polymers and a solvent. Useful polymers include polymers derived from acrylonitrile, vinylidene chloride and acrylic acid and commercial products such as Formvar 7/95, Formvar 15/95 and Butivar B-98 sold by Monsanto Inc. The tie coat has a thickness no greater than 0.0025 mm. and is much thinner than the paint layer. Suitable compositions are disclosed in the Reafler application including the following Table (IV).

TABLE IV

| Tie Coat Composition | |
|---|---|
| Ingredient | Approximate % Weight |
| Deionized water | 75 |
| Acrylic resin | 10 |
| Urethane resin | 10 |
| N—Methylpyrrolidone | 1 |
| Diethylene Glycol Monobutyl Ether | 1 |
| Ethylene Glycol Monohexyl Ether | <1 |
| N,N—Dimethyl Ethanolamine | <1 |
| FC 170 Surfactant, sold by 3M Co. | ~0.05 |

In the drying process of the invention it is important to evaporate the water more rapidly than the organic liquids. As previously mentioned, if the evaporation of the water is retarded too much by excessive air humidity and the organics evaporate first the paint will not coalesce properly. Hence, in the fist three stages of the drying process, conditions are maintained which cause substantial evaporation of water but of no more than a small amount of organic solvents. For example, usually no more than 10 percent of the organic solvents evaporate in these stages while 20 percent or more of the water evaporates. These rates of evaporation are achieved by underside heat supply and by maintaining the required film temperature profile. The conditions which are adjusted to maintain the film temperature profile, include air flow rate, the air temperature, the air humidity and the residence time of the film under these conditions. The latter is determined by the speed of the film through the apparatus.

The inlet air temperature for the first drying stage is only about 5 to 10 degrees C higher than the initial temperature of the wet paint coating as the film enters the first stage. The air flow rate is moderate, for example, about 18 meter/min. (i.e., 18 cu. m./min. per 1 sq.m. of coated surface). The wet coated surface is protected from direct air impingement by baffles such that the wet side heat transfer coefficient is about 0.2K cal/-min./sq.m./deg. C.

The air humidity in the first stage is moderate, e.g., in the range from about 5 to 50 percent RH. As previously explained, if humidity is too low, water evaporates too rapidly and if too high the organics will evaporate before the water.

The humidity is sufficiently low to cause a net withdrawal of water from the wet paint coating but is high enough e.g., above about 20 percent RH, to prevent rapid evaporation of water. By rapid evaporation is meant a rate so high that the film is cooled by evaporation to a temperature more than 10 degrees C below its initial temperature.

FIG. 3 of the drawing illustrates schematically sensing controls 45 and 46 in the air conduit 37 which can sense air temperature and humidity and control them by feedback mechanisms not shown in the drawings, in order to maintain the desired conditions. The air flow rate is also appropriately controlled.

As explained in connection with the drawings the warm air flow is so directed by baffles or otherwise that more than half of the heat supplied to the film to cause evaporation is supplied through its undersurface. A portion of this underside heat is supplied by direct exchange with the warm air which either is fed to the chamber below the film level or which flows from above the film around its edges and into the area below the film. Because of their good heat conductivity, the rollers on which the underside of the film rests supply a substantial or even a major part of the underside heat. The rollers are warmed by the warm air in the chamber or by externally supplied means.

After the first stage in section 33 of the drying apparatus of FIG. 3, drying continues in a second stage at a higher film temperature (but no more than 10 degrees C above the initial film temperature) for at least 30 seconds to continue the evaporation of water and of the higher boiling organics.

In the third stage carried out in section 35 of the drying apparatus, the drying continues for at least 30 seconds at a film temperature (but no more than 25 degrees C higher than the initial film temperature). As a result the rate of evaporation of the water increases and its concentration decreases sufficiently to cause the paint layer to coalesce. Thereafter, in a final curing stage the film temperature is raised to maximum of least 30 degrees C above the highest temperature of the third stage and at least 50 degrees C above its initial temperature for sufficient time to evaporate remaining liquids and harden the paint.

The final curing stage takes place in section 48 of the apparatus. Before entering the final stage the paint has not fully hardened but has coalesced enough that it does not sag when the film is vertical. In the particular embodiment of FIG. 3, the film in section 48 travels through a vertical path, being guided by so-called air reversers to keep the coated side of the film out of contact with rollers which might damage the coating before it is completely hardened. The dried film leaving section 48 is wound on a take-up roll not shown in the drawing.

Figure 5:
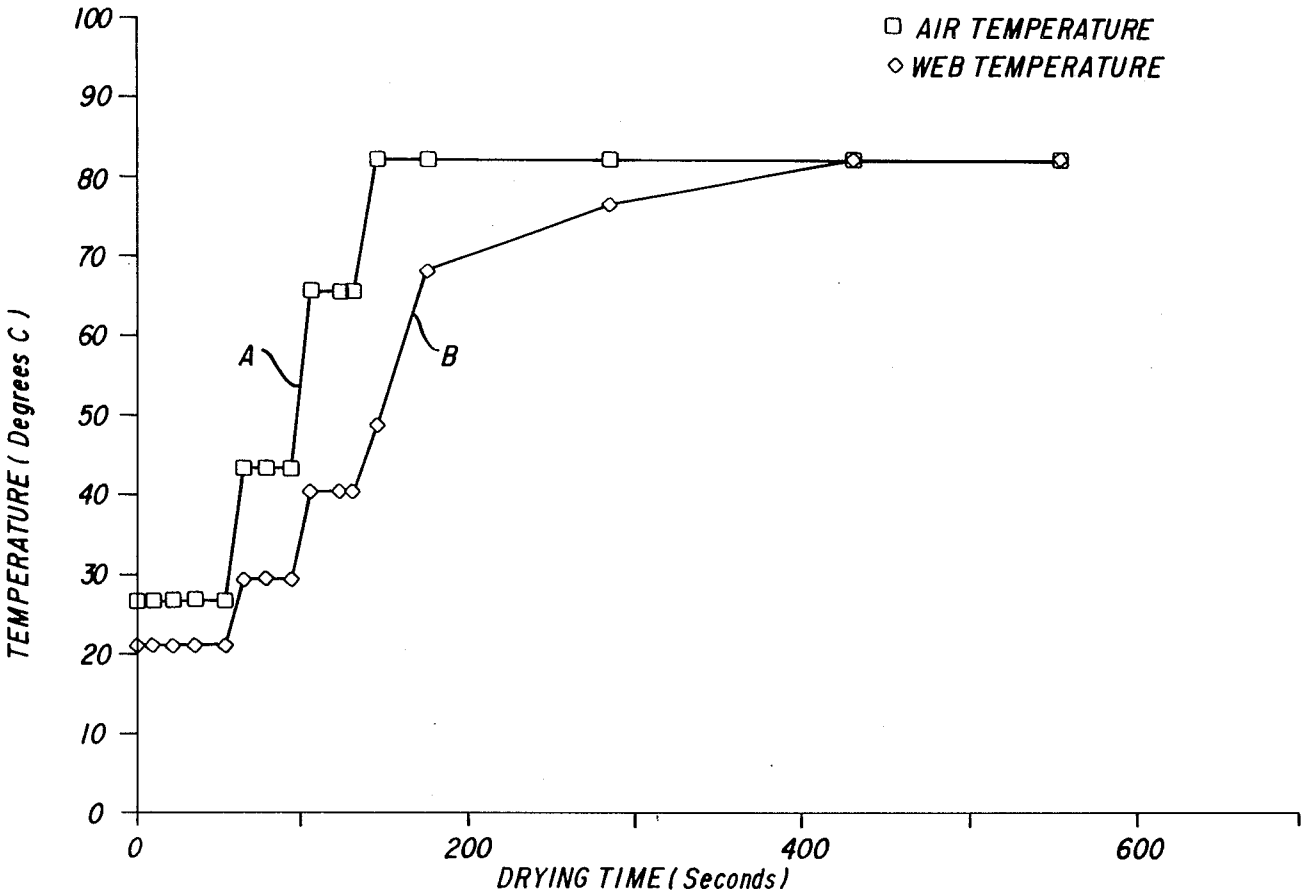
FIG. 5 is a graph of air temperature and film temperature, at different stages in one embodiment of the drying process.

FIG. 5 is a graph which illustrates certain of the features discussed above. It is a plot of the air temperature and of the coated film temperature profile in the drying of a particular paint layer by the process of the invention, the paint being a non-metallic white paint of the type illustrated in Table II. Curve A is a plot of the inlet air temperature for each stage. It shows a temperature of 37 degrees C for the first stage, 43 degrees C for the second stage and 65 degrees C for the third stage and 82 degrees for the final stage.

Curve B is especially significant in showing the optimum temperature profile for the paint layer during successive stages. This temperature can be measured by means of a non-contacting infrared pyrometer which indicates the approximate surface temperature of the paint layer. When the web or film temperature or the paint layer temperature are referred to herein, this is the measurement that is meant. In the specific case illustrated by FIG. 5, the film temperature in the first stage remained within about one degree C of the initial temperature of 21 degrees C for about 50 seconds.

In the second stage of FIG. 5 the temperature of the film rose about 8 degrees C above its initial temperature and stayed at or below about 29 degrees C for about 40 seconds.

In the third stage the film temperature rose about 19 degrees C above the initial temperature and remained at or below 40 degrees C for about 40 seconds.

In the final stage the film temperature rose to a maximum of about 82 degrees C, which is 42 degrees above the highest temperature of the third stage and 61 degrees above the initial film temperature. It is, however, below the thermal deformation temperature of the carrier film, the latter being of the type disclosed in the patent to Weemes, U.S. 4,582,876. The final stage in FIG. 5 continued for about 600 seconds, which is somewhat longer than necessary for evaporation of the remaining liquids, but ensured the hardening of the paint layer.

To achieve such a temperature profile as in FIG. 5 of gradual increase in the paint layer temperature, the various process conditions such as air temperature, air flow rate, supply of heat to the underside of the film, residence time (as determined by film velocity and length of the drying apparatus) and air humidity, are controlled and balanced as has been described herein.

Figure 6:
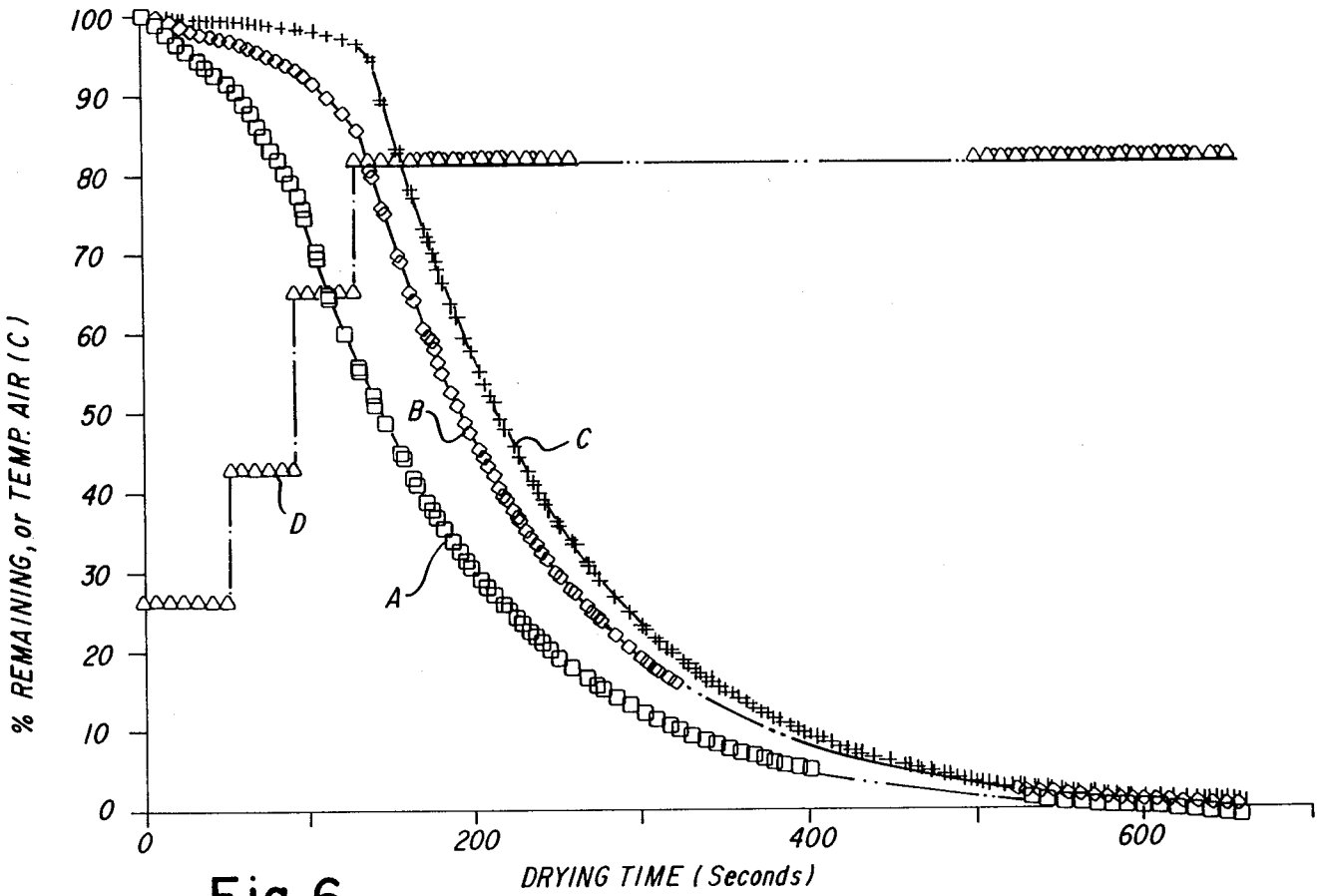
FIG. 6 is a graph of actual air temperature and of computer-calculated liquid concentrations of the paint layer at different stages in an embodiment of the process.

FIG. 6 illustrates how maintaining the film temperature profile of FIG. 5 results in evaporating the water more rapidly than the organic liquids. This figure plots the calculated weight percent of liquids remaining in the paint layer during the successive stages of drying a paint composition of Table II in the manner described for FIG. 5. These are computer-calculated concentration data based on experience from actual runs. Curve A plots the remaining water content of the paint layer. Curves B and C plot, respectively, the remaining amounts of the organic solvents, ethyleneglycol monohexyl ether and of N-methylpyrrolidone. Curve D is a plot of the air temperature in each stage and thus defines the four stages of the process. As shown, the water content decreases by 30 percent or more by the end of the third stage while the organic solvent content decreases by only 20 percent or less.

The following examples further illustrate an embodiment of the invention and provide a comparison with a process which yielded unsatisfactory results.

EXAMPLE 1

In this example the carrier film was of the polymeric composition described in the U.S. patent to Weemes, cited above, which had a heat deformation temperature of about 100 degrees C. Its thickness was about 190 micrometers, its width about 1.1 meter and it had a thin (~0.5 um) dried coating of a tie coat composition as shown in Table IV. Over the tie coat a paint layer was coated continuously by means of a laminar flow extrusion hopper, after which the coated film passed directly to a drying apparatus of the FIG. 3 type. The wet coating was of thickness sufficient to form a dried paint layer of about 0.040 mm in thickness. The paint was a white, non-metallic paint containing about 45 weight percent water, about 12 weight percent organic liquids and about 43 weight percent solids. It was approximately of the composition shown in Table III, above. The drying apparatus had three consecutive horizontal stages and a final stage in which the film was conveyed in a series of vertical loops as in the final stage of FIG. 3. The length of each horizontal stage was about 9.1 meters. The length of the film path in the final stage was approximately 110 meters. The initial temperature of the coated film entering the first stage of the drying apparatus was room temperature, i.e., approximately 20 degrees C. The rate of film travel was approximately 11 meters per minute. Warm, moderately humid air (to percent RH) was fed to each stage by the conduits 37 and 40 of FIG. 3 at progressively higher temperatures for each stage, and at flow rates and other conditions adjusted to maintain the required film temperature in each stage. The space between each edge of the film and the walls of the apparatus in the first three stages was approximately 25 cm, allowing air to flow freely to the lower portion of the chamber below the film level and to warm the steel rollers on which the film was supported. In the first stage the film was supported initially by a series of ten closely spaced steel rollers, about 8 cm. in diameter. Thereafter, in each of the first three stages the film was supported on steel rollers of about 8 cm. diameter spaced about 0.6 to 0.9 meters apart.

Table V shows the inlet temperature of the air in each stage and the range of film temperature for the indicated period of time in the stage. Film temperatures were measured on the coated side of the film using a non-contacting infrared pyrometer (Raytek Raynger Model 380-AF temperature probe). No substantial difference in temperature between the coated side and the underside of the film was observed. The resulting dried white paint layer was smooth, uniform in appearance, glossy and was essentially free of bubble defects.

TABLE V

| Drying of Non-Metallic Paint Layer | | | | |
|---|---|---|---|---|
| Stage | 1 | 2 | 3 | 4 |
| Air Inlet Temp., degrees C. | 27 | 43 | 66 | >82 |
| Film Temp., degrees C. | 10–16 | 21–27 | 38–43 | 66–91 |
| Duration, sec. | 51 | 51 | 51 | ~600 |

The importance of controlling the drying conditions to provide the described film temperature profile is illustrated by the following control example.

CONTROL EXAMPLE

In this example the carrier film, the coating hopper and the drying apparatus were the same as in Example 1 of the invention. The difference was that the paint was a metallic paint of substantially the composition shown in Table I. It contained about 5 weight percent aluminum flake. It also had a lower solids content and a somewhat higher water content than the paint composition of Example 1. When the film coated with this metallic paint composition was dried without adjusting the drying conditions of Example 1 to maintain the required film temperature profile, the paint layer blistered badly. Table VI lists the air temperatures and the film temperatures measured in this example.

TABLE VI

| Drying of Metallic Paint Layer | | | | |
|---|---|---|---|---|
| Stage | 1 | 2 | 3 | 4 |
| Air Inlet Temp., degrees C. | 27 | 43 | 66 | >82 |
| Film Temp., degrees C. | 16–27 | 32–38 | 48 | 66–82 |
| Duration, Sec. | 51 | 51 | 51 | ~600 |

Tables V shows that the air temperatures and other process conditions maintained the required film temperatures with the non-metallic paint. Those same conditions, however, were not satisfactory for the metallic paint. As Table VI shows, the temperature of the metallic paint layer rose above the required temperatures in each of stages 1, 2 and 3. This indicates overheating of the film each stage. The reason evidently is that the aluminum particles increased the heat conductivity of the paint layer. This would require adjustment of the drying conditions such as air temperature, residence time or humidity in order to maintain the film temperature profile. In an effort to avoid bubble defects the drying of this film was continued at a lower air temperature in the final stage but with all other conditions and film temperatures in the first three stages being the same. The bubble defects were reduced but the film was unsatisfactory because of film blocking when the film was rolled up, indicating incomplete drying of the paint layer. If the drying conditions are adjusted to maintain the required film temperature profile and to supply more than half of the heat of evaporation to the underside of the film, a metallic paint coating as in Table I can be dried without causing bubble defects or blocking.

It should be understood that the drying stages of the process of the invention are defined by the evaporation conditions rather than by physical locations. Thus, a drying stage can take place in one or more drying chambers if they ar all under the same atmospheric conditions. Likewise, two stages can take place within a single chamber if the conditions differ sufficiently within sequential regions of the chamber. Furthermore, the duration of any or of each of the stages can be considerably longer than the minimum time of 30 seconds for each of the first three stages, provided that the maximum temperature of each stage is not exceeded.

Although the Example 1 and FIG. 3 illustrate an embodiment which has three drying stages followed by a curing stage, the process of the invention is not limited to that particular number of stages. For more gradual increase in the film temperature it is possible to have more than three stages before the final or curing stage.

The invention has been described in detail with particular reference to preferred embodiments thereof, but it will be understood that variations and modifications can be effected within the spirit and scope of the invention.

We claim:

1. A process for drying a coating of wet latex paint on a heat-deformable plastic film, the paint containing water, one or more higher boiling organic solvents and a colloidally dispersed, coalescable, hardenable, elastomeric film-forming polymer to obtain a smooth, stretchable dried paint layer substantially free of bubble defects, which comprises passing continuously through a series of drying stages a heat-deformable plastic carrier film having an upper and an under surface and having on its upper surface a coating of the wet latex paint, introducing a flow of heated, moderately humid air to each stage to supply heat and cause evaporation of water and organic solvent, the air flow in at least the first three stages being so directed that more than half of the heat required for evaporation is supplied to the film through its under surface, in a first stage of at least 30 seconds duration, controlling the evaporation conditions, including the flow rate, humidity and temperature of the air to maintain the temperature of the paint layer within about 10 degrees C below and 5 degrees C above its initial temperature, in a second stage of at least 30 seconds duration maintaining conditions which heat the paint layer to a temperature higher than in said first stage but no higher than 10 degrees C above its initial temperature, in a third stage of at least 30 seconds duration maintaining conditions which heat the paint layer to a temperature higher than in said second stage but no higher than 25 degrees C above its initial temperature;

thereafter in a final stage maintaining conditions which heat the paint layer to a maximum temperature at least 30 degrees C higher than the highest temperature in the third stage and at least 50 degrees C higher than its initial temperature for sufficient time to evaporate remaining water and organic solvent and harden the paint layer, the temperature being below the heat deformation temperature of the carrier film.

2. A process according to claim 1 wherein the water is evaporated at a more rapid rate than the organic solvent.

3. A process according to claim 2 wherein the water content of the paint is reduced sufficiently before the final stage to cause it to coalesce.

4. A process according to claim 3 wherein the paint contains at least 50 weight percent water and at least 10 weight percent organic solvent.

5. A process according to claim 4 wherein at least 60 percent of the heat supplied to the film in the first three stages is supplied through its under surface.

6. A process according to claim 5 wherein the air humidity in the first stage is from 5 to 50 percent RH.

7. A process according to claim 6 wherein heat is supplied to the underside of the film by heat exchange contact with warm, heat conductive film supporting means.

8. A process according to claim 7 wherein the film supporting means includes warm rollers.

9. A process according to claim 8 wherein said paint contains at least 50 weight percent water, at least 5 weight percent higher boiling organic solvent and at least 20 weight percent solids.

10. A process according to claim 9 wherein the thickness of the dried paint layer is from 0.020 to 0.060 mm.

11. A process according to claim 10 wherein the paint contains metallic flake.

12. A process according to claim 10 wherein the film-forming polymer comprises a urethane resin and the organic solvent comprises N-methylpyrrolidone.

13. A process according to claim 12 wherein the paint layer temperatures are maintained at 20 to 25 degrees C in the first stage, at 26 to 33 degrees C in the second stage, at 38 to 43 degrees C in the fourth stage and from 65 degrees C to below the heat deformation temperature of the film in the final stage.

14. A process according to claim 1 wherein the wet paint on the plastic film is a uniform, smooth layer which is coated on the film by laminar flow coating.

15. A process according to claim 13 wherein the wet paint layer is coated on the film by extrusion through a narrow slot immediately before the coated film is passed through the first drying stage.

* * * * *